US005990624A

United States Patent [19]

Maya

[11] Patent Number: 5,990,624

[45] Date of Patent: Nov. 23, 1999

[54] COLOR SULFUR LAMP INCLUDING MEANS FOR INTERCEPTING AND RE-MITTING LIGHT OF A DESIRED SPECTRAL DISTRIBUTION

[75] Inventor: Jakob Maya, Brookline, Mass.

[73] Assignee: Matsushita Electric Works R&D Laboratory, Inc., Woburn, Mass.

[21] Appl. No.: 08/533,444

[22] Filed: Sep. 25, 1995

[51] Int. Cl.[6] ..... H01J 65/04

[52] U.S. Cl. ..... 315/39; 315/248; 315/344

[58] Field of Search ..... 315/39, 248, 267, 315/344

[56] References Cited

U.S. PATENT DOCUMENTS

| | | | |
|---|---|---|---|
| 4,427,923 | 1/1984 | Proud et al. | 315/39 X |
| 4,532,427 | 7/1985 | Matthews et al. | 315/248 X |
| 4,978,891 | 12/1990 | Ury | 315/248 X |
| 5,404,076 | 4/1995 | Dolan et al. | 315/248 X |
| 5,597,052 | 1/1997 | Maya et al. | 315/248 X |

*Primary Examiner*—Benny T. Lee

*Attorney, Agent, or Firm*—Perkins, Smith&Cohen; Jerry Cohen

[57] ABSTRACT

A discharge lamp (10) based on microwave excitable sulfur gas with enhanced red component of visible light emission from the lamp as a whole, the lamp having an arc discharge tube (18) light source, microwave excitation means (M) and an outer inert zone around the arc discharge tube having a layer of phosphor (16) selected to absorb a portion of blue-green spectral component of the arc discharge tube emission and emit a concentrated red region of spectral range of light to combine with non-red spectral components of light passing through the phosphor. The phosphor can be essentially homogeneous material or may comprise a mixture of distinct phosphor types and/or a multi-layered array.

17 Claims, 5 Drawing Sheets

COLOR SULFUR LAMP INCLUDING MEANS FOR INTERCEPTING AND RE-MITTING LIGHT OF A DESIRED SPECTRAL DISTRIBUTION

BACKGROUND OF THE INVENTION

This invention provides an electrodeless sulfur lamp that has an improved color compared to existing sulfur lamps. As is well known, high power density sulfur lamps tend to have their peak light output around the green region of the spectrum and when one looks at them they have a greenish tinge. The present invention ameliorates this situation and improves the color toward the red such that different color objects look more normal and enriched.

BACKGROUND OF THE INVENTION

Dolan, Ury and Wood in their 1992 paper, "A Novel High Efficiency Microwave Powered Light Source" (6th Int'l Symposium on Science and Technology of Light Sources, Budapest, Sept. 2, 1992), describe a novel higher frequency microwave powered light source which contains primarily sulfur and argon gas. This source emits visible radiation throughout the spectrum with a peak as shown in FIG. 3 of the paper around 550 nm (green) light. The way the system operates is by having sulfur under high pressure and radiating from upper excited electronic states to the ground state resulting in a broadband source of radiation. Sulfur is very benign and there is no interaction with the quartz envelope. As a result one could obtain reasonably long life under very severe high loading conditions. The typical lamps contain something to the order of about 3400 watts in a 28 mm diameter glass bulb. In order to prevent any condensation of sulfur the bulb has to be rotated and that results in uniform distribution of the species inside the bulb resulting in uniform light distribution.

Furthermore, the frequency of operation of such a light source is 2.45 GHz which is obtained from commercially available magnetrons. The typical configuration of such an arc tube is at the center of the such that the microwave radiation is focused onto the light source and it heats the source up very quickly. Striking and restriking the light source is very quick because there is a lot of energy which is concentrated on the bulb and this tends to elevate the vapor pressure very rapidly. This is certainly a distinct advantage of the sulfur light source. It has been the desire of the manufacturers to change the color of such a light source and increase the red content such that it becomes less greenish and more reddish. A color change of this nature would make this light source much more attractive. Further technical details of the operation of such a light source and the photometric characteristics can be found in the Dolan et al. publication and also in some subsequent publications. There are a number of patents also that have been issued in relation to this type of lamp.

There are, in principle, a variety of ways of improving the red content of such a light source.

For example one can introduce additives that may change the color toward the red. However this method has apparently been tried and has not been very successful because it interferes with the operation of the sulfur and interacts with the glass due to the high power density and high temperature that exists in this bulb. For example there are many rare earth metals that one could consider as additives such as Lanthanum or Europium or some other rare earth metals or rare earth metal halides which give a lot of radiation (e.g., $ScI_3$, $DyI_3$). These chemicals would tend to dissociate under the hot plasma temperatures in the center of the discharge and then the metals would diffuse towards the walls and interact with the quartz. This would weaken the quartz and result in catastrophic failure of the light source in a very short time. Therefore additives of either rare earths or alkaline metals in the form of halides or some other chemical compounds would not be very beneficial Another technique to have more red content could be as follows: One could use an outer bulb that has tinted color in such a manner that the green is absorbed more than the red. This would proportionately increase the red content in the lamp thereby shifting the x/y coordinates. However that would tend to reduce the efficacy of the light source.

SUMMARY OF THE INVENTION

The present invention provides an apparatus and process meeting the foregoing object as follows:

An outer chamber is placed around an inner arc tube. This could be in the form of a flat panel (plate) that is outside the arc tube that is put on the fixture or in the form of a outer bulb which is evacuated and surrounds the particular arc tube containing sulfur (see FIG. 1 herein). A phosphor is applied on a majority (preferably all or nearly all) of the inner wall (i.e. inner surface facing the arc tube) of this chamber or plate. The phosphor is selected for some absorption in the blue and green regions of the spectrum and emission in the red. There are phosphors that have very broad bands of absorption in the blue-green region and they re-emit in the orange, yellow and red regions of the spectrum. The efficiency of radiation is typically quite high and therefore there is no particular loss of efficiency. On the other hand, there is a shifting of the spectrum a little towards the red in such a manner as to make the light source, as a whole, much more attractive than state-of-the art lamps of the type described above.

An overall correlated color temperature (CCT) of between 3500 and 6500 of the emitted light from the lamp is achieved consistent with optimal operation of the arc discharge light source, the phosphors and the outer bulb structure, or the like.

It is a principal object of the present invention to provide an enhanced higher frequency, microwave powered light source with higher red content compared to the state of the art Other objects, features and advantages of the invention will be apparent from the following detailed description of preferred embodiments taken in conjunction with the accompanying drawing in which:

BRIEF DESCRIPTION OF THE PREFERRED EMBODIMENT

Figure 6B:
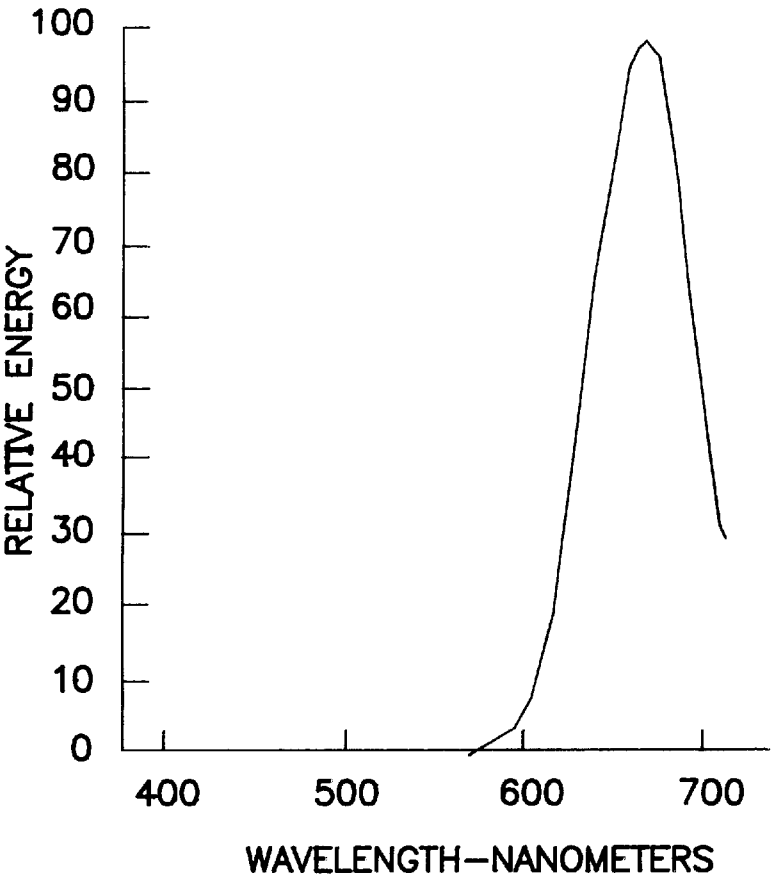
Figure 6A:
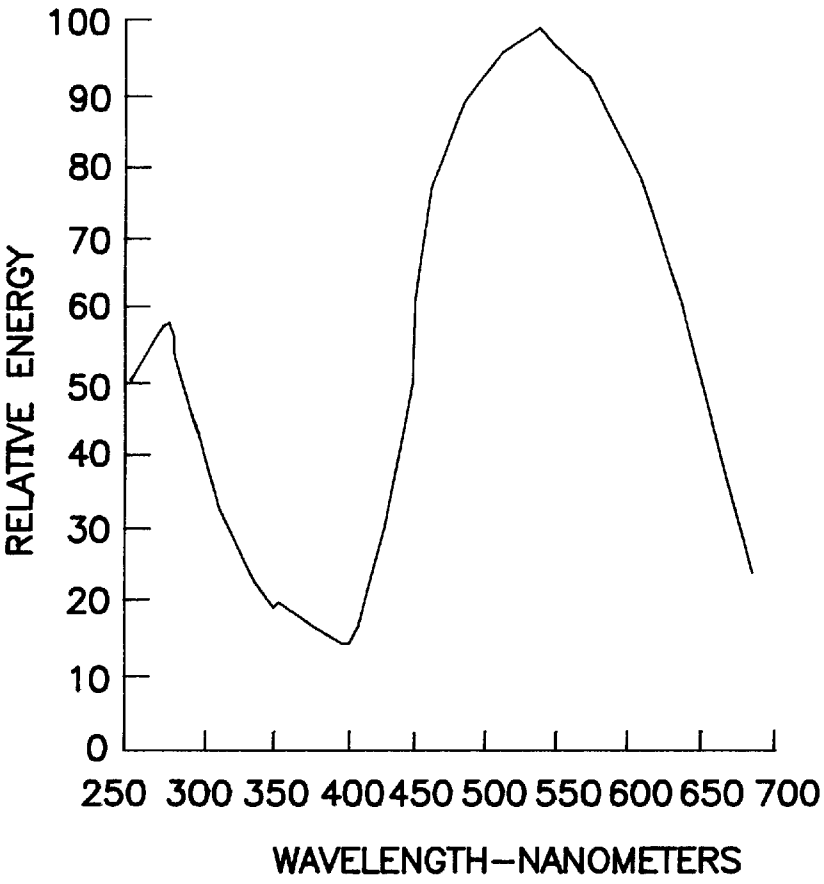
Figure 7:
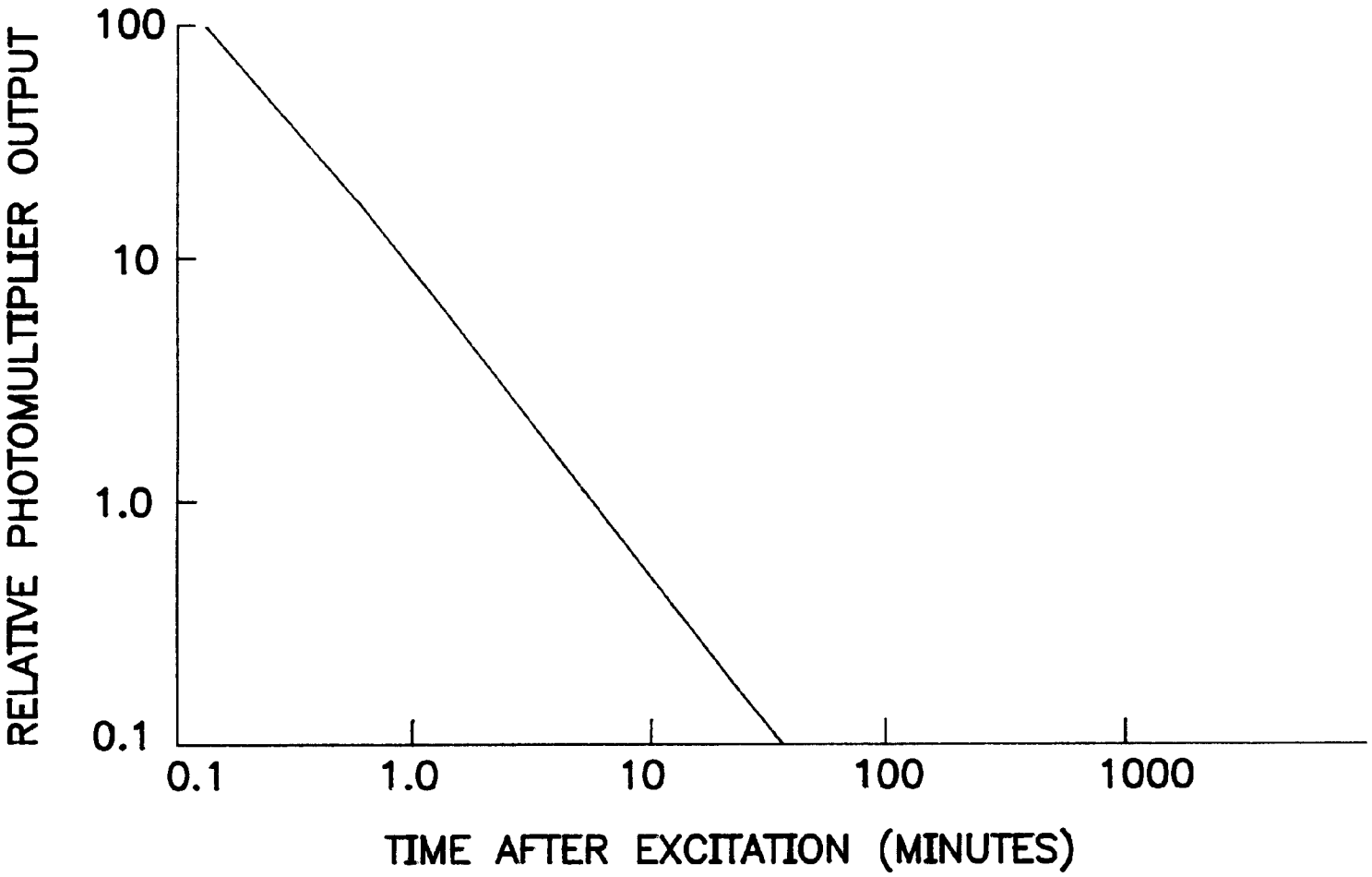

FIGS. 6A/6B are excitation and emission spectra for yet another phosphor; and FIG. 7 is a persistence curve (log-log) for the FIGS. 6A/6B phosphor.

DETAILED DESCRIPTION OF THE PREFERRED EMBODIMENTS

Figure 1:
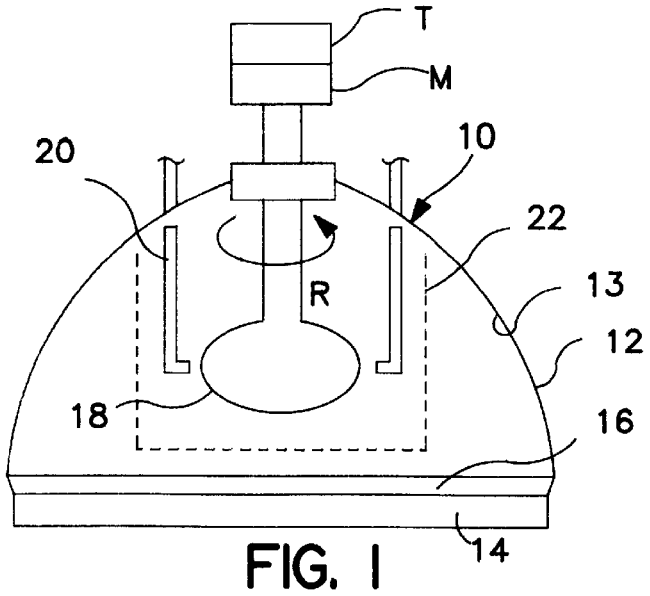
FIGS. 1 and 2 are cross-section views of two preferred embodiments of lamps made in accordance with the invention.

A first preferred embodiment is shown in FIG. 1. In this embodiment a lamp (fixture) 10 comprises a conventional per se outer chamber 12 with an inner, optically reflective surface 13, over a curved portion and a flat (or slightly dished) plate 14. Plate 14 has an interior coating 16 of a phosphor selected for spectral ranges of absorption/emission criteria as described below. An inner arc tube 18 (preferably essentially spherical) is rotatably mounted within the lamp and fixed coolant feed tubes 20 are provided to transmit a cooling fluid (typically nitrogen) on the surface of the rotating arc tube. A standard rf screen enclosure 22 surrounds the tube. The spherical surface of the tube spreads the cooling gas vertically along the tube to assure substantially complete and uniform exposure to cooling effect. The arc tube has a sulfur gas fill. A microwave source indicated at M and a tube rotator indicated at T, for rotating the tube as indicated by arrow A complete the basic structure of the lamp (apart from conventional seals, packaging, circuit feedthrough, and power supply elements not shown herein). The microwave source can operate at 10 to 5,000 watts of power and within a 30 MHz to 3.0 GHz frequency range.

All the radiation which is emanating towards plate 14 is captured by this plate. The environment in which the phosphor layer 16 exists is clean and pure. That is the kind of environment that is required for the proper operation of the lamp to prevent friction between the air surrounding the bulb and the fast rotating bulb causing deterioration of the glass and therefore shortening of life of the bulb. In such a setting the radiation impinging upon the particular phosphor is shifted in wavelength and what the end user sees would be a shift in spectrum of the lamp toward the red.

Figure 2:
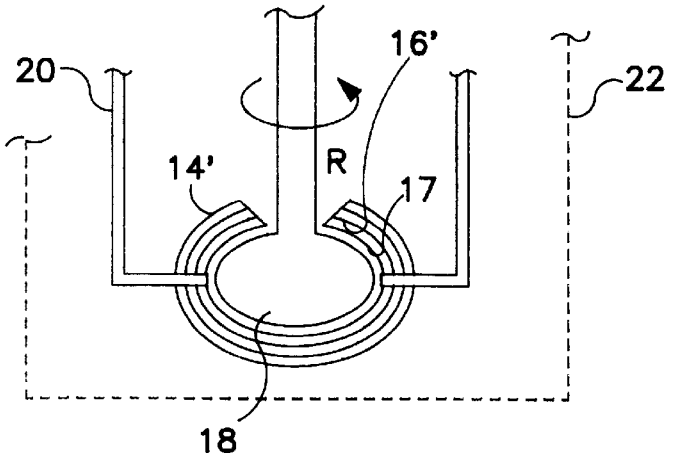
Figure 3:
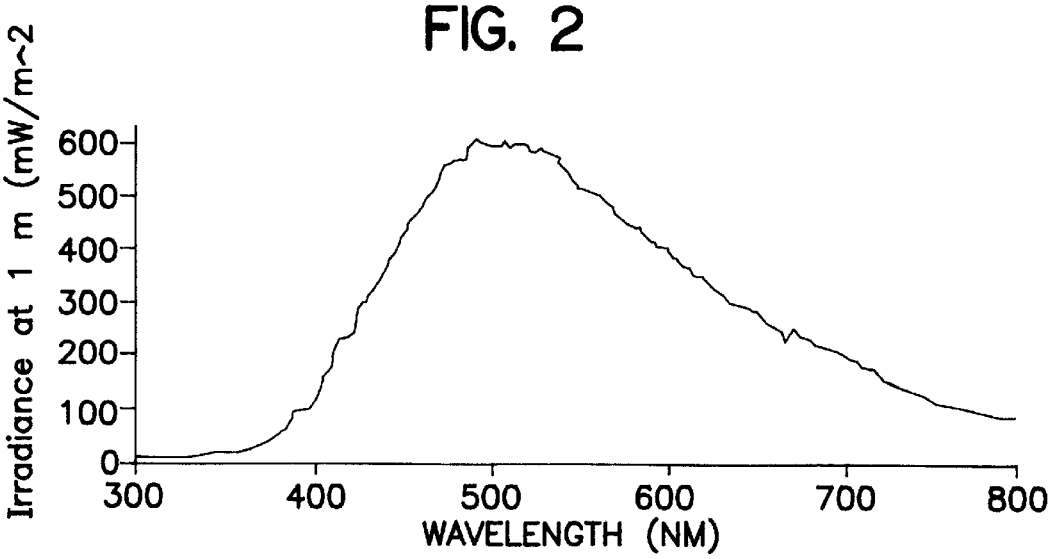
FIG. 3 PRIOR ART
FIG. 3 is a prior art trace of irradiance over a wavelength spectrum for a defined minimum high pressure sulfur lamp (i.e. an irradiance spectrum)

A second preferred embodiment is shown in part in FIG. 2. The balance of this embodiment (not shown) would be constructed as shown in FIG. 1 herein for the FIG. 1 embodiment. In the FIG. 2 embodiment the arc tube 18° is surrounded by an open bulb 14'. The inside or the outside of this bulb is coated with the particular phosphor 16' which shifts the radiation from green toward red and the phosphor is over-coated with a protective layer 17 on top [of it] thereof so as to protect the phosphor from the elements or from any kind of contamination so that the useful life of this particular phosphor would be reasonably long. Other lamp components as designated by the same reference label as in FIG. 1 but are not described herein or other forms of microwave powered sources can be used.

It is very clear to people well versed in the art of lamp making that other particular configurations of glass or geometries or materials could also be envisioned. The main point is to surround the sulfur arc tube with a particular phosphor containing structure so that the observer sees most of the emanating light only after it has been exposed to the phosphor. Three particular examples of phosphors and their absorption and emission spectra are shown in FIGS. 4A, 4B, 5A, 5B and 6A, 6B herein.

Figure 4B:
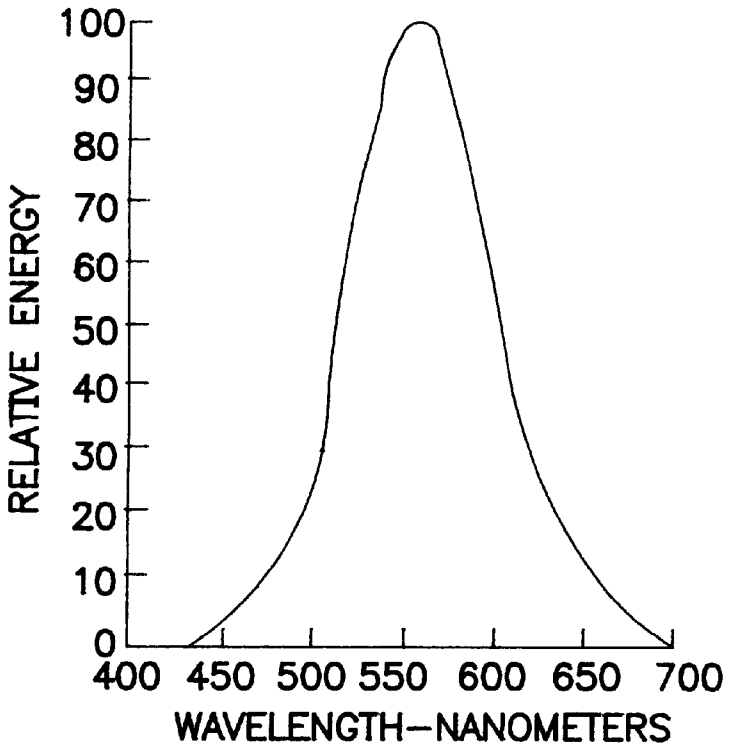
FIGS. 4A and 4B are excitation and emission spectra, respectively, for a certain phosphor type.
Figure 4A:
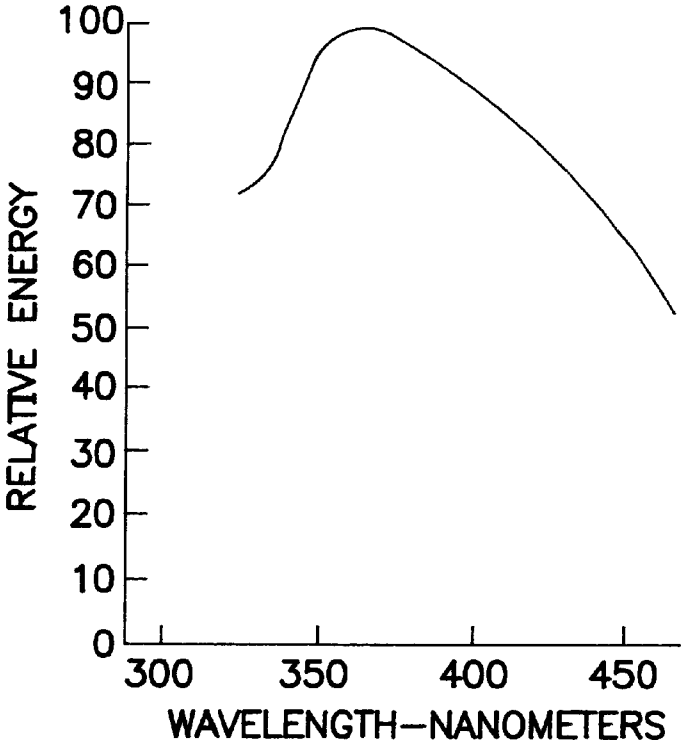
Figure 5B:
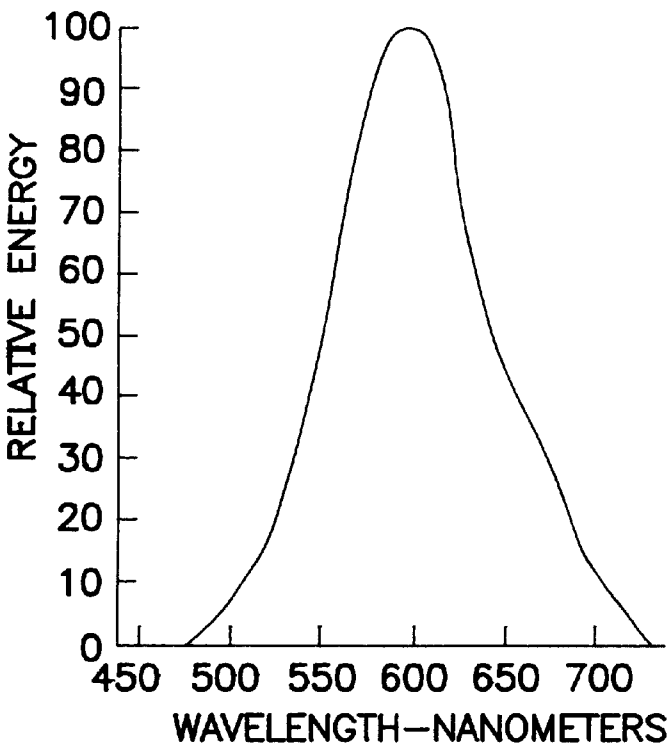
FIGS. 5A/5B are excitation and emission spectra for another phosphors.
Figure 5A:
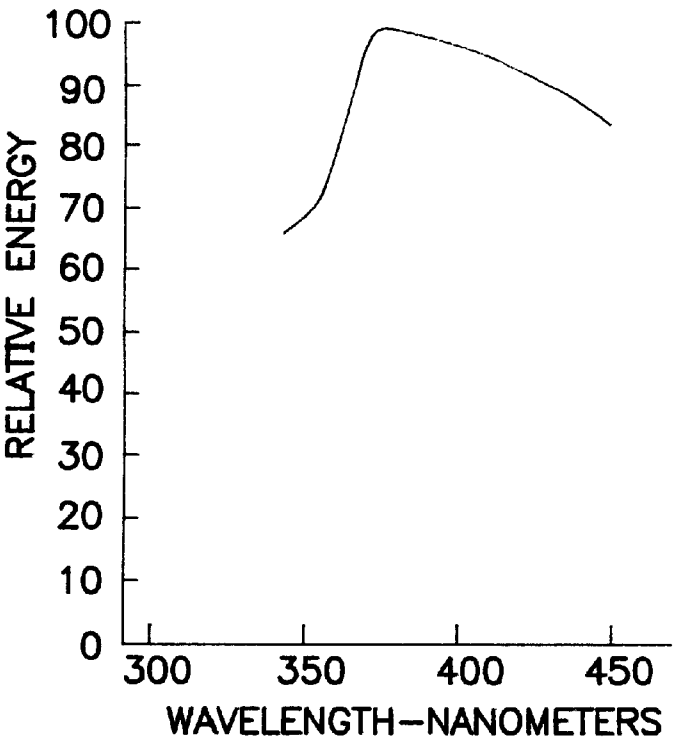

The phosphor type in FIGS. 4A, 4B is Sylvania Type Number 140 (JEDEC no. P-7 yellow). It comprises a ZnCdS (i.e. ZnS, CdS mixture) doped with copper and has FSSS defined as—Fisher Sub-Sieve Sizing (a well known process for the last 50 years)/4.8 micron particles with a particle size distribution (Coulter Counter) of 95 w/o defined as weight percent, minus 33.6 microns; 50 w/o minus 18.5, 5 w/o minus 5. It has a relative Cr brightness as determined calorimetrically vs. a standard P-20 phosphor as 100. (P-20=100) of 66 and a long decay classification. FIG. 4A shows its excitation spectrum and FIG. 4B its emission spectrum. As shown in FIG. 4B, emission peaks at 560 nm with a band-width at 50% of about 88 nm. Its International Commission on Illumination (ICI or CIE) color coordinates are x=0.407,[4] v=0.539. Its optimum screen weight for conventional purposes (e.g. radar) is 6 mg/cm$^{3,}$ The phosphor whose excitation/emission spectra are depicted in FIGS. 5A/5B is Sylvania Type 146 (JEDEC no. p-14, orange). It also comprises a ZnCdS mixture doped with Cu of FSSS 26 micron particles with a distribution (micromerograph) of 95 w/o minus 48.5 microns, 50 w/o minus 29.5, 5 w/o minus 8; relative Cr brightness (P-20=100) of 17 and a medium decay classification. As FIG. 5B shows, peak emission is at 600 nm with a 50% bandwidth of 96 nm. Color coordinates are x=0.511 and y=0.466.

FIGS. 6A, 6B show excitation and emission spectra of another phosphor, Sylvania Type 930, that fluoresces red (peak emission wavelength at 670 nm with a 50% bandwidth of 70 nm). It comprises a calcium-strontium-sulfide mixture doped with Europium as FSSS 16 microns powders in a full density of 12.6 g/u. Its ICI color coordinates are x=0.668, y=0.313. It has a "long" decay classification with emission persisting after removal of the excitation light source to the degree indicated in FIG. 7, a log-log plot of relative photomultiplier output (of a photomultiplier receiving the emission) vs. time after removal of excitation.

In all of the types of phosphors described above and other preferred embodiments, relative energy roll-off from peak is at least 580 nm.

As can be seen from FIGS. 4A, 4B 5A, 5B, 6A and 6B, the phosphors do absorb between 300 and 650 nanometers (including a 310–380 nm zone) and re-emit at higher wavelength than the light absorbed in preferred regions of the spectrum (500–700 nm). Emission above 600 nm is particularly preferred since that is purely red. The thickness of the phosphor would have to be adjusted in such a manner that the majority of the radiation in the blue green region does pass through and is transparent but a certain amount of it, a small percentage of it, is absorbed and re-emitted in the red to improve the color somewhat. This can be done by some prior modeling as well as some experiments whereby different thickness layers of phosphors are exposed to the radiation coming out of the sulfur lamp and the spectra as well as the efficiency and total lumens are measurable and the optimum be determined for the most desirable light source for a particular application.

The above described phosphors and many other effective choices are readily available and they are consistent with being excited by many kinds of radiation. Often the very fact that the phosphor does not have to be exposed to ions since electrons (and in the present invention the phosphor ion is not going to be inside the arc tube) makes it very attractive because that avoids a situation in which these phosphors would disintegrate or deteriorate. If these were to be put inside the arc tube then there would be a problem with the maintenance and also the disintegration of the phosphor. However since only photons would be impinging upon these phosphors and they would be contained in an inert atmosphere of rare gas or nitrogen there is no danger of their disintegration or deterioration. These features make the invention a very practical system for the application of the sulfur lamp. In some cases, the temperature of the phosphor may get to a high level resulting in deteriorated performance. In such a case some cooling using airjets may be necessary.

It is clear that the phosphors mentioned above may be used as individual phosphor or some mixture of them. Likewise they could be multi-layered to take advantage of this slightly varying absorption characteristics. It is also apparent that other more efficient phosphors not cited above could be used to the same advantage.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

I claim:

1. A lamp, comprising, in combination:

(a) means with a first wall defining an enclosed volume containing microwave-excitable gas, under a pressure in excess of 1 atmosphere, (b) a microwave power source operating at 10 to 5000 W power and within a frequency range of 3.0 MHz to 3.0 GHz for exciting the gas of the enclosed volume by supply of microwave energy hereto to establish a high pressure arc of the excited gas in the volume and to cause the gas to emit visible light, of a narrow spectral range peaking in the blue-to-green region of the visible light spectrum, which passes through said first wall, (c) means with a second wall defining a zone located outside said enclosed volume and substantially adjacent thereto (d) means in said zone for intercepting at least a portion of visible spectrum component of light emitted from said volume and passing through said first wall and (e) said means for intercepting absorbing a portion, but not all, of said blue to green spectral region components of such intercepted light and emitting visible light outside the zone and outside the lamp, by passage through said second wall with a higher red spectral portion as compared to the intercepted light, the visible light emitted from the lamp comprising a mixture of the blue-to-green light as emitted from the arc as a majority component and the emitted light from said means for intercepting as a minority component, whereby an overall CCT (color temperature) of the emitted light from the lamp of between 3500 and 6500, is achieved consistent with optimal operation of said volume defining means and said power source and said means for intercepting comprises phosphor material with peak excitation between 300 and 600 nm wavelength of incident light and peak emission between 520 and 620 nm wavelength of emitted light.

2. Lamp in accordance with claim 1 wherein the zone is evacuated.

3. Lamp in accordance with either of claims 1 or 2 wherein said excitable gas comprises sulfur as a principal component and the phosphor material comprises a mixture of cadmium strontium sulfide doped with europium.

4. Lamp in accordance with either of claims 1 or 2 wherein the phosphor comprises a layered multi-array.

5. Lamp in accordance with either of claims 1 or 2 wherein said excitable gas comprises sulfur as a principal component and the phosphor material comprises a mixture of zinc cadmium sulfide doped with copper.

6. Lamp in accordance with claim 1 wherein the phosphor comprises a layered array.

7. Lamp in accordance with claim 1 and further comprising:

a construction of the power source such that said power source prevents the microwave-excitable gas volume, under excitation, from heating said means for intercepting to a level of deterioration thereof.

8. Lamp in accordance with claim 7 wherein said defining means comprise a rotating enclosure and said power source comprise means for supplying at least one jet of cooling gas to cool an outer surface of said enclosure, the zone defining means comprising a space around the enclosure containing means, which absorb and emit, phosphors.

9. Lamp in accordance with claim 8 and further comprising:

means for controlling the cooling gas throughput and removing the cooling gas from such space at a rate to maintain a vacuum level below $10^{-2}$ Torr therein substantially throughout lamp operation.

10. Lamp in accordance with claim 8 wherein the said zone outside said enclosed volume is defined by an outer bulb substantially completely surrounding said volume and having a dispersed array of phosphor as a bulb interior surface coating therein that substantially completely covers the bulb surface so that substantially all light exiting the bulb has a higher red spectral portion enhanced by a factor of at least 1.1 as compared to the light emitted from the said enclosed volume.

11. Lamp in accordance with claim 8 wherein said zone substantially completely surrounds said enclosed volume and comprises an outer bulb wall which has part reflective and part transmissive portions, the transmissive portion being coated on its interior with said intercepting means, which absorb and emit, and the two bulb wall portions coact with each other and said enclosed volume so that substantially all light radiated from the latter intersects the coated transmissive portion of the outer bulb.

12. Process of maintaining an illuminating visible light emission with enhanced red component of observed visible light emission comprising the steps of:

(a) striking and maintaining a microwave excited arc discharge in a confined gas volume to emit radiation in upper excited electronic states of the gas in arc discharge including emission of visible blue-to-green light, (b) intercepting a majority of the said radiation in a protected zone outside such volume by phosphor material selected to absorb radiation in a blue-green visible spectral range and emit radiation at a red visible spectral range, and (c) passing a combination of (1) the radiation that is not absorbed by the phosphor, as a majority and (2) radiation emitted by the phosphor, as a minority to outside observation beyond the protected zone.

13. Process in accordance with claim 1 including the steps of arranging the phosphor material comprises a material with a peak excitation between 300 and 600 nm wavelength of incident light and peak emission between 500 and 700 nm wavelength.

14. Process in accordance with claim 13 including the steps of arranging the emission 50% bandwidth of the phosphor material is under 200 nm and the relative energy roll off from peak is at least 580 nm.

15. Process in accordance with claim 14 including the steps of arranging the said 50% bandwidth is under 100 nm.

16. Process in accordance with claim 8 including the steps of arranging the phosphor material as a multi-layered array.

17. Process in accordance with claim 12 wherein the said step of arc discharge maintenance and light emission is a microwave excitation of a sulfur gas filled arc tube, said arc tube having external cooling and the protected zone is a vacuum region surrounding the arc tube with the said phosphor provided as a layer therein that blocks a path between the arc tube and outside observation.

* * * * *